US007247789B2

(12) United States Patent
Fishman et al.

(10) Patent No.: US 7,247,789 B2
(45) Date of Patent: Jul. 24, 2007

(54) SOUNDHOLE ACCESSIBLE MUSICAL INSTRUMENT CONTROL PLATFORM

(75) Inventors: Lawrence Fishman, Winchester, MA (US); Benjamin Bateman, Epping, NH (US)

(73) Assignee: Fishman Transducers, Inc., Wilmington, MA (US)

( * ) Notice: Subject to any disclaimer, the term of this patent is extended or adjusted under 35 U.S.C. 154(b) by 30 days.

(21) Appl. No.: 11/334,044

(22) Filed: Jan. 18, 2006

(65) Prior Publication Data

US 2006/0156913 A1 Jul. 20, 2006

Related U.S. Application Data

(60) Provisional application No. 60/644,807, filed on Jan. 18, 2005.

(51) Int. Cl.
*G10H 3/08* (2006.01)
*G10H 3/12* (2006.01)
*G10H 1/32* (2006.01)

(52) U.S. Cl. ..... 84/723; 84/723; 84/725; 84/730; 84/743

(58) Field of Classification Search ..... 84/723
See application file for complete search history.

(56) References Cited

U.S. PATENT DOCUMENTS 2,293,806 A * 8/1942 Dawson ..... 84/726
3,763,736 A * 10/1973 Williams ..... 84/329
3,780,202 A * 12/1973 Law ..... 84/726
3,869,952 A * 3/1975 Rowe ..... 84/727
4,151,777 A * 5/1979 Sugiyama et al. ..... 84/723
4,227,434 A * 10/1980 DiMarzio ..... 84/723
4,394,830 A * 7/1983 Damiano ..... 84/726
4,501,186 A * 2/1985 Ikuma ..... 84/726

(Continued)

OTHER PUBLICATIONS iMix Installation & User's Guide, JR Baggs, pdf created Jan. 27, 2004, http://www.Irbaggs.com/manuals/imix_manual.pdf and http://www.Irbaggs.com/html/products/systems_imix.shtml.*

(Continued)

*Primary Examiner*—Lincoln Donovan
*Assistant Examiner*—Robert Horn
(74) *Attorney, Agent, or Firm*—Weingarten, Schurgin, Gagnebin & Lebovici LLP

(57) ABSTRACT

A soundhole accessible musical instrument control platform mounted inside the body of a musical instrument requires no physical alterations to the instrument, allowing the user convenient and ergonomic access to the control platform through the soundhole while using the musical instrument. The control platform includes a circuit platform, mounted inside the instrument with adhesives, separably attached to a mounting bracket. Control detents and markings are easy to feel and to read and thus provide feedback for control position and the relative degree of effect. The controls are surrounded by a cosmetic bezel that hides the actual mounting mechanism and circuitry. Any combination of controls, circuitry, and sensors may be used. Power is either provided onboard or offboard. An output connector may be integrated into the circuit platform or via an endpin jack. Input signal connectors, present on the circuit platform, are configured to accept pickups that are mounted either internally or externally to the body of the musical instrument, or to accept a combination of internal and external pickup mounts.

5 Claims, 4 Drawing Sheets

U.S. PATENT DOCUMENTS

| | | | | | |
|---|---|---|---|---|---|
| 4,748,886 | A | * | 6/1988 | De Byl | 84/723 |
| 4,941,389 | A | * | 7/1990 | Wendler | 84/727 |
| 5,010,803 | A | * | 4/1991 | Donnell | 84/743 |
| 5,194,686 | A | * | 3/1993 | Winkler | 84/743 |
| 5,401,900 | A | * | 3/1995 | Lace | 84/743 |
| 5,422,955 | A | * | 6/1995 | Guzman et al. | 381/77 |
| 5,438,158 | A | * | 8/1995 | Riboloff | 84/727 |
| H001503 | H | * | 12/1995 | Threadgill | 84/723 |
| 5,567,903 | A | * | 10/1996 | Coopersmith et al. | 84/723 |
| 5,614,688 | A | * | 3/1997 | Donnell | 84/743 |
| 5,689,082 | A | * | 11/1997 | Youngblood | 84/743 |
| 5,731,535 | A | * | 3/1998 | Hudak | 84/733 |
| 6,121,528 | A | * | 9/2000 | May | 84/411 R |
| 6,274,801 | B1 | * | 8/2001 | Wardley | 84/731 |
| 6,441,293 | B1 | * | 8/2002 | LaBarbera | 84/723 |
| 7,015,390 | B1 | * | 3/2006 | Rogers | 84/723 |
| 7,074,998 | B2 | * | 7/2006 | Hurwicz | 84/454 |
| 7,084,341 | B2 | * | 8/2006 | Barr | 84/743 |
| 7,135,638 | B2 | * | 11/2006 | Garrett et al. | 84/725 |
| 2004/0074380 | A1 | * | 4/2004 | Fishman | 84/741 |
| 2006/0117938 | A1 | * | 6/2006 | Gillette | 84/723 |
| 2006/0156913 | A1 | * | 7/2006 | Fishman et al. | 84/743 |

OTHER PUBLICATIONS

West Coast Trilogy, Dean Markley, http://www.deanmarkley.com/Pickups/TrilogyMore.shtml, review at http://www.musiciansfriend.com/product/Dean-Markley-West-Coast-Triology-Acoustic-Pickup-System?sku=304013.*

* cited by examiner

SOUNDHOLE ACCESSIBLE MUSICAL INSTRUMENT CONTROL PLATFORM

CROSS REFERENCE TO RELATED APPLICATIONS

This patent application claims the priority benefit of U.S. Prov. Pat. Appl. No. 60/644,807, filed Jan. 18, 2005, incorporated herein by reference.

STATEMENT REGARDING FEDERALLY SPONSORED RESEARCH OR DEVELOPMENT

N/A

BACKGROUND OF THE INVENTION

Musical instruments such as acoustic guitars often require amplification and tone adjusting means when used in a performance setting. Vibrational energy is detected in the guitar by the use of sensors such as pickups or electromechanical transducers, devices which produce a very low power signal. In order to minimize signal loss, such signals are preamplified proximate to the instrument. In conjunction with such preamplification, various controls are typically provided which can affect, for example, the volume and tone of the preamplified signal.

One example of a preamplification and signal modification system is provided by Applicant's commonly owned U.S. Pat. Pub. No. 2004/0074380, filed Apr. 22, 2004. This system is preferably disposed in a side surface of an acoustic guitar. This solution may not appeal to all musicians, however, due to the need to remove a portion of the instrument side surface.

BRIEF SUMMARY OF THE INVENTION

The presently disclosed soundhole accessible musical instrument control platform is designed to allow a combination of electronic elements including sound modifying controls, electronic circuitry and a variety of types of sensors to be mounted inside the body of a musical instrument in such a way as to produce no damage or irreversible physical alterations to the instrument, and to allow the user convenient and ergonomic access to the features of the control platform through the soundhole while using the musical instrument.

The term "sensors" as used hereinafter refers to electronic devices used for the purpose of detecting musical instrument body vibrations, string movement, or instrument-related air vibrations, to be optionally processed with electronic circuitry and to provide a reproduction of some portion of the sound of the musical instrument. The terms "pickups" and "transducers" as used hereinafter are essentially synonymous with the term sensors for the general function of providing input to the control platform.

There are several advantages of this control platform over previous methods of mounting controls, circuitry and sensors inside a musical instrument. The soundhole accessible musical instrument control platform is composed of a circuit platform separably attached to a mounting bracket. The term "circuit platform" as used hereinafter includes all portions of the control platform except for the mounting bracket and any remotely mounted sensors, connectors or power sources.

The first advantage of this control platform is that the mounting bracket for the control platform is attached inside the instrument with adhesives, not with any irreversible modifications to the instrument. The majority of electronic control systems designed for use with musical instruments, particularly acoustic musical instruments, require at least one hole to be made in the body of the instrument by drilling, cutting, routing or some other similarly destructive operation. These holes are an irreversible modification to the instrument, and incur the risk of immediate damage while being done, as well as causing a potential decrease in the structural integrity of the instrument, and thus an increased risk of damage to the instrument over its lifespan. Additionally, these modifications may lower the collectibility and the resale value of the instrument.

The second advantage of this control platform is that the mechanical design of the mounting system provides stress relief for the adhesive bond between the mounting bracket and the instrument body and permits the circuit portion of the platform, which actually carries the combination of controls, circuitry, and sensors, to be easily and safely removed from the instrument for service, repair or upgrades, as well as to be reattached with precise positioning and no loss of bond strength. This design for simple and controlled removal and reattachment of the circuit portion and associated elements also increases the durability and thus the reliability of the control platform. Additionally, in the preferred embodiment the mounting bracket and the circuit platform are mechanically connected in a manner designed to allow use of the controls with much less perception of wobble than many other soundhole-accessible systems offer. For the few other electronic control systems designed to be mounted inside a musical instrument and to be soundhole accessible, the adhesives used by the majority of them are extremely sensitive to any mechanical stress, and bonding failures are common. Further, none of the other known soundhole-accessible control systems have any removal and reattachment methods more sophisticated than adhesive-backed hook and loop fasteners such as VELCRO (Velcro Industries, B.V.), and those methods offer imprecise positioning, less reliable adhesion, and more of a perception of wobble when any portion of the control system is touched.

A third advantage of this platform is a highly ergonomic design with controls that are easy to reach and use, as well as control detents and markings that are easy to feel and to read and which thus provide instant feedback for control position and the relative degree of effect. Additionally, the controls are surrounded by a cosmetic bezel that hides the actual mounting mechanism and circuitry from sight, giving a more finished and aesthetically pleasing appearance to the platform, and not detracting from the appearance of the musical instrument.

A fourth advantage of this platform over previous soundhole accessible control and preamplifier or "preamp" designs is the flexibility with which it can be used. Any combination of controls, circuitry, and sensors may be used with this platform, with options ranging from a single control or a passive circuit or a single sensor, up to and including complex groups of controls, active analog and digital as well as passive analog circuitry, and multiple sensors including microphones processed and signal-blended onboard. All of these are options, with power either provided onboard through batteries or offboard through remote batteries connected through wires, a power cable from an AC adapter, phantom power from external electronic devices connected to the output, or other power-providing means. If there is other electronic circuitry or separately configured sensing devices present in the instrument, it may be advantageous to electrically connect this platform to that circuitry and those sensing devices for a more flexible and comprehensive set of control options.

The term "microphone" as used hereinafter refers to the actual microphone sensing element in combination with any housing, enclosure or mechanical support directly attached to and surrounding the sensing element.

Yet another advantage of this platform is that an output connector may be integrated into the circuit platform such that an output signal cable may be attached through the soundhole, preventing the need for even as minor a permanent alteration to the musical instrument as drilling into the tailblock of the instrument and attaching an endpin jack. Likewise, input signal connectors may be present on the circuit platform, configured to accept pickups that are mounted either internally or externally to the body of the musical instrument, or to accept a combination of internal and external pickup mounts.

BRIEF DESCRIPTION OF THE SEVERAL VIEWS OF THE DRAWINGS

The presently disclosed invention will be more fully understood with reference to the following Detailed Description in conjunction with the drawings of which.

DETAILED DESCRIPTION OF THE INVENTION

Figure 1:
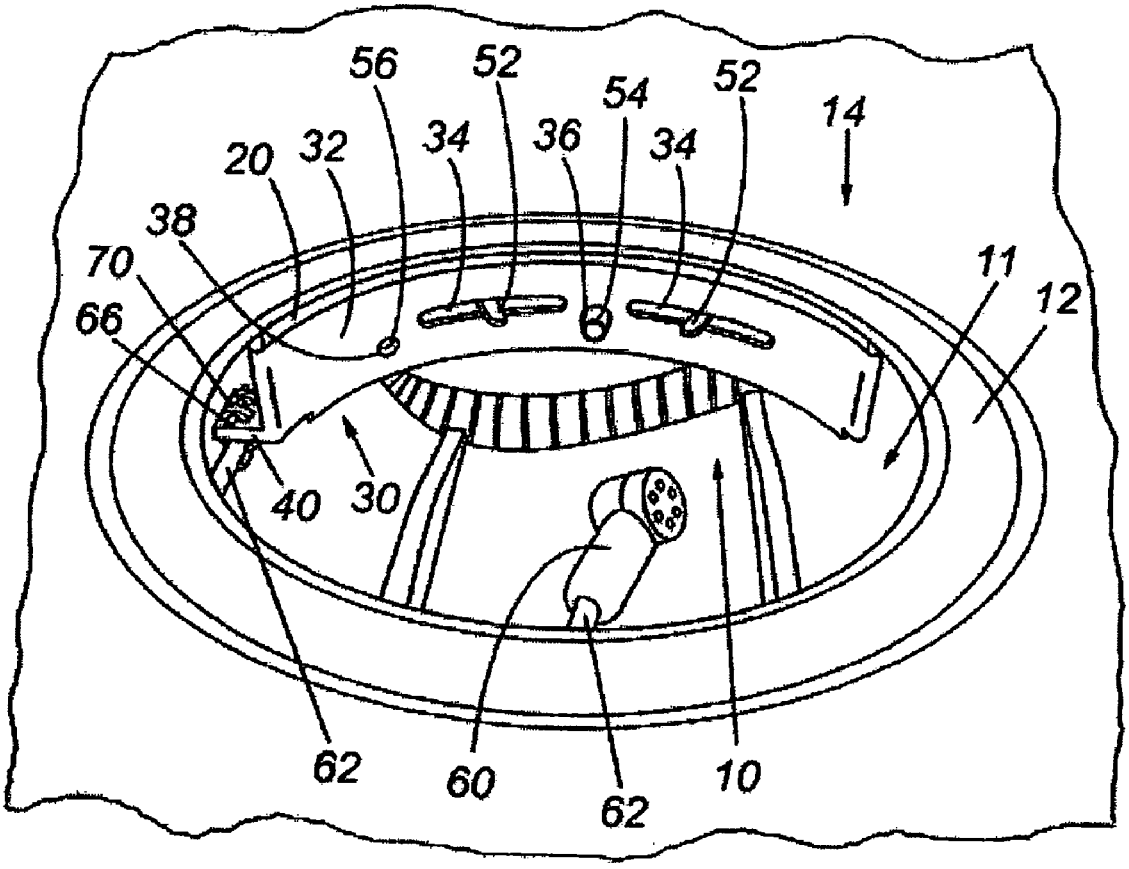
FIG. 1 is a perspective closeup of the soundhole area of an acoustic guitar with the soundhole accessible musical instrument control platform and gooseneck microphone visible inside the soundhole and the strings removed from the view for clarity.

In the preferred embodiment of the control platform, the mounting bracket is formed of a commonly available molded plastic such as Nylon 6, but may also be formed of sheet metal or any other material with some degree of flexibility and sufficient ability to be shaped as needed for the purpose. In the preferred embodiment, the bezel of the control platform is also formed of a commonly available molded plastic such as Nylon 6, but may be formed of any material suitable for maintaining a durable aesthetic appearance inside the soundhole of a musical instrument while providing the structural integrity necessary to maintain the placement of the circuitry, controls, and any directly attached components such as sensors and connectors.

The control platform has a unique mounting system, employing in the preferred embodiment a mounting bracket secured to the inside of the musical instrument top by a means for adhering, preferably being some variety of doublestick tape. This doublestick tape may be a film of adhesive, a film or other sheet of thin material having adhesive on both faces, or a thin sheet of foam material having adhesive on both faces. In the preferred embodiment, this tape is a relatively thin foam-bodied doublestick tape or a material with similar bonding and handling characteristics. Other means for adhesion may include an application of Room Temperature Vulcanizing (RTV) type adhesive or liquid, gel, paste or aerosol spray adhesive or some combination of these to both the selected musical instrument surface and the mounting bracket surface. Optionally, intermediary layers may be employed with any of these means for adhesion to modify the physical properties of the adhesive bond. This tape or other adhesive means preferably produces a strong bond with controlled flexibility between the mounting bracket and the inside of the instrument top. This flexibility also serves to allow the musical instrument top to vibrate naturally while the instrument is played, thus the preferred embodiment of the mounting system has a minimum of interference with the acoustic performance of the instrument.

This mounting bracket design is intended to allow the surface area of the adhesive bond to be increased to a practical maximum, while still fitting in between the pattern of structural reinforcing elements commonly found in the tops of the majority of musical instruments for which it is intended. In a preferred embodiment of the invention, the circuit platform is magnetically secured to the mounting bracket in such a way as to allow a small amount of flexibility in the mechanical joint, and to allow relatively easy and controlled removal of the circuit platform for battery changing, input attachment, output attachment and access to any circuit platform features that may require service, repair, calibration or other adjustment.

The preferred means for magnetically securing the bezel to the mounting bracket uses a pair of permanent magnets substantially enclosed in plastic bosses extending perpendicularly out from the bracket away from the musical instrument top, and a pair of recesses formed in the circuit platform bezel, with steel pins secured to the bottoms of the recesses. In the preferred embodiment, the magnets are of the Neodymium Iron Boron type. The recesses are formed to receive the bosses with a small amount of mechanical play allowed in the fit, with the magnets preferably almost but not actually contacting the steel pins when the bosses are fully inserted in the recesses. This contact gap is controlled in the design and manufacture of the control platform parts to allow a sufficient but not overly strong attraction force to retain the circuit platform to the mounting bracket over time, yet allow easy and controlled removal and reattachment of the circuit platform when necessary. The preferred small amount of mechanical play in the fit of the bosses and recesses also serves to allow a portion of the forces encountered in the use of the controls to be absorbed by the mechanical and magnetic joints rather than by the adhesive joint.

In an alternate embodiment, the recesses are lined with relatively stiff rubber or other slightly flexible and relatively high surface friction material, in forms that may include o-rings, grommets or sleeves to allow slightly more controlled movement at the joint between the preamp and the bracket. Other embodiments of the control platform may have fewer or more than two bosses and recesses, or may use a different geometry of securing elements to achieve the means for magnetically securing the bezel to the mounting bracket. Still other alternate embodiments of the means for securing include but are not limited to such nonmagnetic means as the use of spring clips bearing against surfaces with detents or other retention shapes, or friction areas. Any means for securing that includes an easy, controlled and repeatable release and reattachment may be used in this instance. Additionally, the mounting bracket is preferably formed to have a mechanical bias against the bezel when the two are magnetically attached, this bias being intended to stiffen the joint and prevent any perception of wobble while using the controls.

The combination of the adhesive and magnetic securing methods in the preferred embodiment avoids the problems associated with standard temporary fasteners such as hook and loop attachment systems, where the bond is prone to wobble and tends to deteriorate over time, especially with repeated detachment and reattachment use. This intentional controlled flexibility in the preferred mechanical joint is also designed to prevent tearing, shearing, peeling or other modes of failure in the adhesive bond between the musical instrument surface and the mounting bracket.

The controls in the preferred embodiment of the soundhole accessible musical instrument control platform are a sliding type master volume control, a sliding type panning control between the two signal channels, a pushbutton type phase inverting switch, and a screwdriver-accessible microphone level trimming control that is designed to be used for occasional level adjustments. Alternate embodiments of this invention may have fewer, more or other controls, including but not limited to individual signal channel level controls, tone controls for one or more channels, controls for multiple frequency bands and sweep of frequency ranges to define frequency bands to control, notch filters for purposes including feedback suppression, controls for sound effects including but not limited to chorus or reverb, and specialized Digital Signal Processor (DSP)-based controls for any of the previously mentioned functions as well as for sound modeling and sound imaging. The user may access these controls through means including but not limited to sliding levers and knobs, rotary knobs, pushbuttons, touchpads, joysticks or controls combining any of these functions.

Additional electronic circuit functions may include buffering, impedance shifting and signal level shifting. The preferred embodiment of the control platform employs active electronic circuitry, although passive limited-capability embodiments of the control platform can be made, too.

The preferred embodiment of the soundhole accessible musical instrument control platform has at least two signal inputs, preferably a vibration sensing transducer and a microphone. The vibration sensing transducer is preferably composed of either a piezo ceramic or a piezo polymer material, intended to be installed under the saddle in the bridge of the instrument by means not described here but well known to those skilled in the art. This preferred type of transducer does require some routing of the saddle slot and trimming of the saddle, as well as for a hole to be drilled in the saddle slot. Some other types of transducers, sensors or pickups may also require holes to be drilled in a portion of the instrument, or other permanent modifications to the instrument. The microphone sensing element is preferably of the miniature electret type, and there is a microphone signal wire contained within a gooseneck type stem connected between the microphone body and the bezel to transmit electrical signals from the microphone to the circuitry located on the printed circuit board that is mounted on the bezel.

The microphone and gooseneck are joined to the circuit platform by a means for securing the gooseneck that is attached to and at least partially built into the bezel, and that is designed to allow limited and controlled manual positioning of the gooseneck as an aid to optimal microphone placement within the soundhole for best sound reproduction.

Other embodiments of the control platform may use different types of pickups, including but not limited to magnetic, accelerometer, non-electret microphone, optical sensing or any other means for sensing time-varying mechanical events such as musical instrument body vibrations, string movements and air resonances, and transforming these events into electrical signals. Additionally, other embodiments of the control platform may use different pickup mounting schemes.

Power for the circuitry is preferably supplied by at least one battery, either attached to the preamp circuitry directly through a battery connector and onboard battery mount, or remotely attached through wires, with the battery secured elsewhere inside or outside the musical instrument. In an alternate embodiment, the battery power may be supplied through jumper wires from another active electronic device located inside the musical instrument, and the battery may be physically associated with that device. In other alternate embodiments, power may be supplied through an AC adapter plugged into a connector mounted either onboard the platform or elsewhere in the instrument and connected by wires to the circuitry, or may be supplied by phantom power through another electronic device connecting via the output connector.

A preferred circuit platform embodiment includes a cosmetic bezel that is shaped to fit under the edge of the instrument soundhole and to follow a section of the soundhole curve. When installed in the instrument, the only portions of the circuit platform that are visible through the soundhole are the cosmetic elements of the bezel and the user accessible portions of the controls. The circuitry is joined to the bezel in such a way as to be out of sight when the circuit platform is installed in the instrument. If a battery is mounted on the circuit platform, preferably the battery is mounted to be out of sight in the finished installation as well. In addition to the many other improvements described previously, this control platform improves cosmetically over other soundhole accessed control systems by offering a much more finished and integrated appearance. An alternate embodiment of the bezel may have a facing of wood veneer or other decorative material, to better integrate the control platform with the aesthetics of the musical instrument.

In use, the soundhole accessible musical instrument control platform produces at least one output signal which may be sent directly through a signal cable to an output connector installed in the instrument, or optionally the output signal may be sent through a signal cable to a previously installed preamp circuit including the endpin-jack-mounted style of preamp circuit, in which case that embodiment of the control platform requires less circuitry, since the output drive stage is provided by the existing preamp. In the latter embodiment, the soundhole accessible musical instrument control platform, particularly its controls, can serve as an upgrade to the existing circuitry inside the instrument, and power may also be supplied to the control platform from the battery powering the existing circuitry, or through external means via an onboard connector.

Additionally, more than one control platform section may be attached around the circumference of the soundhole, giving the option of more ergonomic and functional flexibility. Alternatively, a single mounting bracket may be configured to allow the placement of more than one circuit platform.

While the preferred embodiment has controls arranged around the circumference of the soundhole such that no control device is below or overlapping any other control device, a limited degree of control proliferation may still be ergonomically acceptable in alternate embodiments with control devices stacked or overlapped more than one unit deep into the soundhole.

Figure 2:
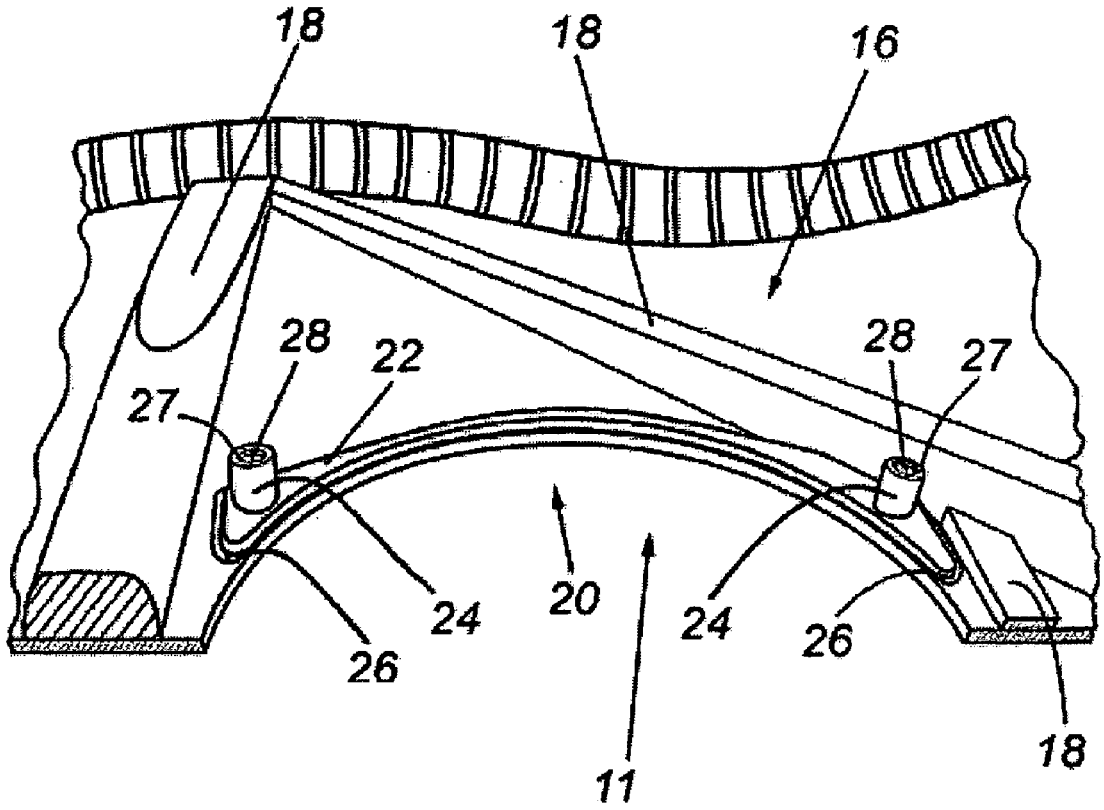
FIG. 2 is a perspective cutaway view of the inside of the top surface of an acoustic guitar with the mounting bracket for the soundhole accessible musical instrument control platform attached.

The soundhole accessible musical instrument control platform 10 is shown in the preferred embodiment in FIG. 1 secured to the underside of a guitar top 14 and is accessible to the user through the soundhole 11. (The instrument's strings have been removed for the sake of clarity.) The bezel 30 is curved to approximately match the shape of the soundhole 11, with the rosette 12 illustrated to make the orientation more clear. The bezel face 32 provides a cosmetic appearance for the control platform 10, and features openings for the various user-accessible control features, including the slide control slots 34 for the slide control levers 52, the pushbutton hole 36 for the pushbutton 54, and the trimmer hole 38 for the trimmer control 56. Additionally, the bezel 30 positions the gooseneck strain relief assembly 70 around the gooseneck strain relief platform 40, from which the gooseneck cable 62 extends to end in the microphone housing 60 which contains the microphone element. The bezel 30 is held in place by the mounting bracket 20, with the mounting bracket 20 shown in FIG. 2 secured to the underside of the guitar top 16 by adhesive 26. The mounting bracket 20 in the preferred embodiment is shaped to fit between the majority of patterns of guitar body structural elements 18 and is composed of a bracket base 22 and two bracket bosses 24. Each bracket boss 24 extends perpendicularly from the face of the bracket base 22 opposite the bracket face contacting the adhesive 26, and ends in an inwardly directed flange that serves as a magnet retaining lip 27. Each of the magnets 28 is held at a slight distance back from the tops of the bracket boss 24 by the magnet retaining lip 27, thus establishing part of the control over how strongly the control platform will be secured into the musical instrument.

Figure 3:
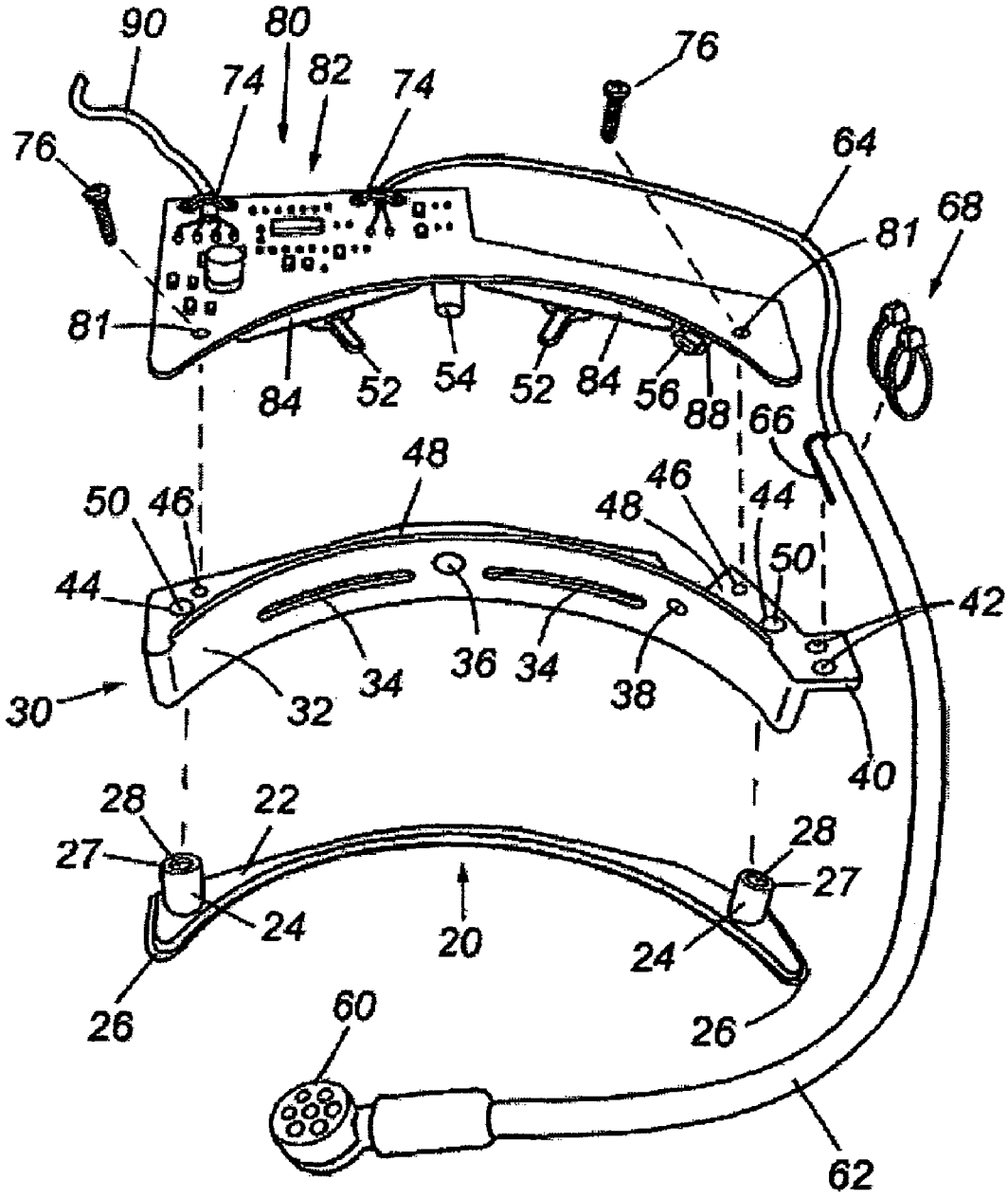
FIG. 3 is an exploded perspective view of the full assembly of the soundhole accessible musical instrument control platform.
Figure 4:
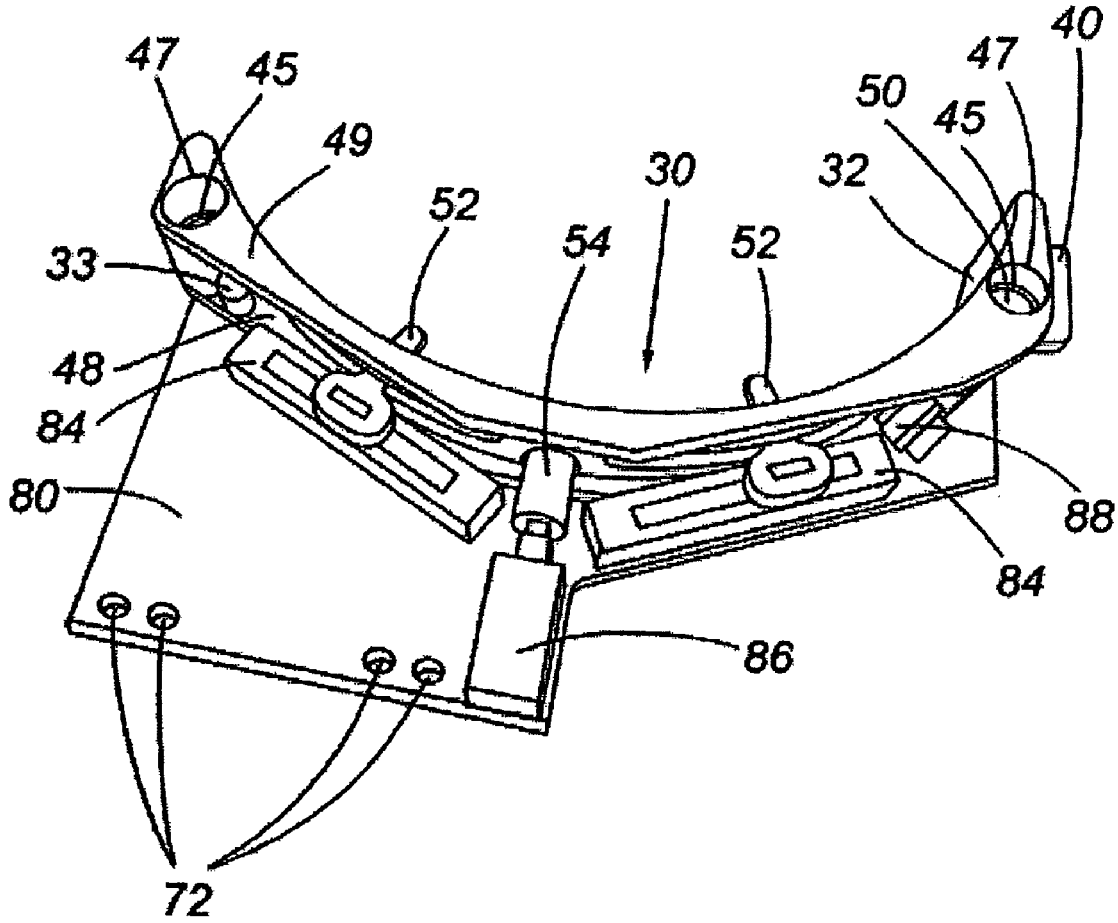
FIG. 4 is a perspective view of the back of the bezel and printed circuit board assembly.

FIG. 3 shows the separate parts of the assembly which compose a preferred embodiment of the control platform 10. The printed circuit board 80 carries the circuitry 82, slide potentiometers 84, pushbutton switch 86 (FIG. 4), trimmer potentiometer 88 for the microphone channel, microphone signal wire 64 and the signal cable 90 which includes pickup input, blended pickup and microphone output, power, and ground leads. Both the microphone signal wire 64 and the signal cable 90 are secured to the printed circuit board 80 with strain reliefs 74 secured through printed circuit board strain relief holes 72. In a preferred embodiment, the printed circuit board 80 and all of the components assembled to it are joined to the bezel 30 along the first stiffening rib sections 48 by two screws 76 through the printed circuit board screw holes 81 into the bezel screw holes 46, each screw 76 fastening into a bezel screw boss 33.

Before the printed circuit board 80 is secured to the bezel 30, the steel pins 50 are inserted into the pin recesses 44. Each of the steel pins 50 is thus captured in place between the printed circuit board 80 and a pin retaining lip 45. The pin retaining lip 45 serves to form the second half of the spacer between the steel pins 50 and the magnets 28 along with the magnet retaining lip 27 to control the retaining force for the control platform 10.

The gooseneck cable 62 is secured to the bezel 30 by placing it on the strain relief platform 40, wrapping the stiffening wire 66 around the strain relief platform 40 and attaching the tiewraps 68 through the gooseneck strain relief holes 42 and around the stiffening wire 66 and gooseneck cable 62 to produce the gooseneck strain relief assembly 70.

To secure the bezel 30 to the mounting bracket 20 in the preferred embodiment, the bezel 30 contains a pair of fastening recesses 47, bound by a second stiffening rib 49. Each fastening recess 47 has at the bottom one of the steel pins 50 positioned by a pin retaining lip 45. When the fastening recesses 47 are placed over the bracket bosses 24 containing the magnets 28 each positioned by a magnet retaining lip 27, the attraction force between the magnets 28 and the steel pins 50 serve to retain the bezel 30 against the mounting bracket 20. Additionally, the bracket base 22 is formed in such a way as to provide a slight mechanical bias against the bezel 30 to stiffen the mounting of the entire control platform 10.

While the present invention has been described in conjunction with a preferred embodiment, one of ordinary skill in the art, after reading the foregoing specification, will be able to effect various changes, substitutions of equivalents and other alterations to the compositions, articles, methods and apparatuses set forth herein. Furthermore, the embodiments described above may each include or incorporate any of the variations of all other embodiments. It is therefore intended that the protection granted by Letter Patent hereon be limited only by the definitions contained in the appended claims and equivalents thereof.

What is claimed is:

1. A soundhole accessible musical instrument control platform, comprising:

a bracket base having a concave curved side and a bracket boss;

a bezel having a concave curved side, a recess configured to receive the bracket boss therewithin and at least one aperture through the concave curved side; and a circuit board at least partially disposed within the bezel, the circuit board comprising at least one control element, accessible through the at least one aperture in the bezel concave curved side, and an interface to an electromechanical transducer disposed in association with the musical instrument, wherein the bracket base is disposed within the musical instrument, adjacent a soundhole perimeter thereof, the bezel being removably mated to the bracket base via a magnetic system collectively disposed within the bracket boss and the recess so that the bezel hides the bracket base and the circuit board from view.

2. The soundhole accessible musical instrument control platform as recited in claim 1, wherein the bracket base is adhesively to the musical instrument.

3. The soundhole accessible musical instrument control platform as recited in claim 1, wherein the bezel includes a facing of wood veneer or other decorative material.

4. The soundhole accessible musical instrument control platform as recited in claim 1, wherein the bracket base provides a mechanical bias to the bezel whereby the joint therebetween is stiffened.

5. The soundhole accessible musical instrument control platform as recited in claim 1, wherein the bracket boss includes a permanent magnet therein.

* * * * *

UNITED STATES PATENT AND TRADEMARK OFFICE

CERTIFICATE OF CORRECTION

PATENT NO. : 7,247,789 B2
APPLICATION NO. : 11/334044
DATED : July 24, 2007
INVENTOR(S) : Lawrence Fishman et al.

It is certified that error appears in the above-identified patent and that said Letters Patent is hereby corrected as shown below:

Column 8, claim 2, line 49, "adhesively to" should read --adhesively attached to--.

Signed and Sealed this

Twenty-seventh Day of May, 2008

JON W. DUDAS
*Director of the United States Patent and Trademark Office*